US007637446B2

(12) United States Patent
Euculano

(10) Patent No.: US 7,637,446 B2
(45) Date of Patent: Dec. 29, 2009

(54) ROLLER MILL FOR GRINDING SOLID MATERIAL

(75) Inventor: Jason S. Euculano, Northampton, PA (US)

(73) Assignee: FLSmidth A/S, Valby, Copenhagen (DK)

( * ) Notice: Subject to any disclaimer, the term of this patent is extended or adjusted under 35 U.S.C. 154(b) by 40 days.

(21) Appl. No.: 11/897,378

(22) Filed: Aug. 29, 2007

(65) Prior Publication Data

US 2009/0057450 A1 Mar. 5, 2009

(51) Int. Cl.
*B02C 15/00* (2006.01)

(52) U.S. Cl. ..... 241/121

(58) Field of Classification Search ..... 271/117–122
See application file for complete search history.

(56) References Cited

U.S. PATENT DOCUMENTS 4,382,561 A * 5/1983 Andersen et al. ..... 241/121
6,113,015 A * 9/2000 Brundiek ..... 241/121

* cited by examiner

*Primary Examiner*—Mark Rosenbaum
(74) *Attorney, Agent, or Firm*—Daniel DeJoseph Esq.; Aaron Pik Esq

(57) ABSTRACT

The invention relates to a roller mill for grinding solid material such as cement raw materials and similar materials, said roller mill comprising a substantially horizontal grinding table and at least two rollers which are configured for interactive operation with said grinding table, wherein at least one of said rollers rotates about a stationary shaft connected to a rocker arm pivotally connected to a mill stand which substantially is situated outside said grinding table and therefore does not utilize a mill stand and the remaining rollers do not utilize a mill stand. According to the invention the number of rollers, and thereby the capacity of the mill is increased without introducing more mill stands.

18 Claims, 4 Drawing Sheets

ROLLER MILL FOR GRINDING SOLID MATERIAL

FIELD OF INVENTION

A roller mill for grinding solid material such as cement raw materials and similar materials, the roller mill comprising a horizontal grinding table and at least two grinding rollers, which are configured for interactive operation with the grinding table.

BACKGROUND OF THE INVENTION

A roller mill of the aforementioned kind is known for example from U.S. Pat. No. 4,828,189. This known mill is a so-called vertical mill and comprises a casing or mill body with a horizontal grinding table positioned within the mill body mounted for rotation about a vertical axis. Drive means such as a motor and a gear reducer, situated beneath the grinding table, are provided for rotating the grinding table. Rocker arms are mounted in the roller mill structure and in the end of each rocker arm a grinding roller is mounted for rotation about an axis, which is situated at a predetermined angle to the table. The load-carrying mill structure is assembled from a plurality of mill stands, one for each grinding roll. Each grinding roll assembly, consisting of a grinding roller, axle, hub and bearing, requires a mill stand to support the force mechanism, such as a hydraulic cylinder, which generates the grinding pressure and which is mounted in the mill stand.

It is essential to have the ability to remove a mill's gear reducer, as its components are subject to heavy stress loading and therefore may need to be occasionally replaced. As the mill stands are main parts of the structure and heavily stressed, they are usually welded together and, with the mill body, permanently fixed into the foundation, for example by epoxy grout and foundation anchor bolts. Because of this, vertical mills are generally limited to a maximum of four permanent mill stands, one for each grinding roll assembly, as the space between the mill stands otherwise will be too narrow for replacement of the gear reducer. While possible, it is not ideal to remove one of the mill stands in order to replace or repair the gear reducer.

Alternately it is possible to increase the number of mill stands, and thereby the number of grinding rollers, by moving the mill stands significantly outwards. This typically requires that the other mill components such as roller axles, grinding table and rocker arms become much larger. The higher costs due to such an increase in component size counteract any profit gained due to the mill capacity increase realized by increasing the number of grinding rollers. A different means of providing more grinding rollers is therefore desirable.

DISCLOSURE OF THE INVENTION

It is the object of the present invention to provide a roller mill with an increased number of rollers, in order to increase the capacity of the mill, without the above-mentioned drawbacks.

This is obtained by means of a roller mill of the kind mentioned in the introduction wherein at least one of the full size mill rollers does not utilize a mill stand for attachment purposes and is instead attached by means which allow it to rotate about a shaft located above and over the mill table. In one embodiment at least one roller rotates about a stationary shaft attached to an interior frame situated in the central part of the grinding table, with the mill having at least one other roller that conventionally rotates about a stationary shaft connected to a rocker arm or similar structure pivotally connected to a part of the roller mill structure, typically a mill stand, which is situated outside the grinding table.

Pursuant to the present invention the number of rollers is increased and the capacity of the mill is increased without introducing more mill stands.

The roller mill of the present invention can comprise two, three, four or more roller assemblies connected to mill stands and two, three, four or more additional roller assemblies do not operate in conjunction with mill stands, or any combination thereof, according to the desired capacity of the roller mill. Typically, but not always, the number of roller assemblies connected to mill stands will be equal to the number of roller assemblies that do not operate in conjunction with mill stands. It is a further feature that the rollers that do not utilize mill stands are full size and force rollers that essentially are indistinguishable in their size and grinding capabilities from the rollers that utilize mill stands.

It is preferred that the rollers not connected to mill stands and the rollers connected to the mill stands be situated alternatively around the grinding table.

It is preferred that the axial center line of the interior frame coincide with the axial center line of the grinding table so that the rollers are symmetrically positioned around the grinding table.

The shafts for rollers attached to the frame may be connected permanently by means of welding or in a removable way such as by means of flanges on the shafts and corresponding flanges provided on the frame, whereby the flanges could be fixed by means of screws or bolts.

The frame is prevented from moving in the direction of rotation of the grinding table by means of horizontal draw bars or pressure bars, which at one end are attached to brackets on the stationary shafts attached to the frame and at the other end connected to the roller mill structure. Further means could be provided on the roller mill structure to prevent the shafts from making undesired movements in the radial direction of the grinding table.

In order to obtain sufficient grinding pressure the rollers on the frame are forced against the table by draw bar assemblies. On the outer end of each roller shaft is pivotally mounted a bracket to which the draw bar with a force application device such as a hydraulic cylinder is attached. Hereby the rollers can be forced against the grinding table by means of the hydraulic cylinders as these are pivotally retained in brackets anchored in the mill foundation. The hydraulic cylinders may, for example, be substituted by other means such as a system of springs.

When installed these draw bar assemblies will not require the reduction gear being removed, as the draw bar assemblies will be mounted between the mill stands, but due to the simple, light and demountable construction of these assemblies they are easy removed when the gear reducer is to be changed.

Alternatively, the rollers not connected to mill stands may rotate about a vertical shaft, wherein the rollers are connected to the vertical shaft via a hinged connection with a center of rotation which allows for a free circular movement of the roller in upward and downward direction in a plane comprising the centerline of the roller shaft, and which set of rollers is configured for interactive operation with the grinding table. It is a feature of the invention that the center of rotation of the hinged connection in a vertical plane is situated under the horizontal plane which comprises the center of mass of the roller, roller shaft and the hinge part connected thereto. Therefore, it will be possible to increase the grinding pressure without use of force mechanisms. This is due to the fact that the centrifugal force which, during the operation of the mill, acts upon the roller, the roller shaft and the hinge part connected thereto, because of the special design defined above will produce a turning moment around the hinge and hence a force directed downward against the grinding table.

In order to attain a high speed of rolling, defined as the relative speed between the rollers and the grinding table, and hence a high capacity of the mill, it is preferred that the set of rollers and the grinding table are turned in opposite directions.

DESCRIPTION OF THE DRAWINGS

The invention will now be described in further details by way of an example of a roller mill according to the invention and with reference to the following drawings, in which.

DETAILED DESCRIPTION OF THE INVENTION

Figure 1:
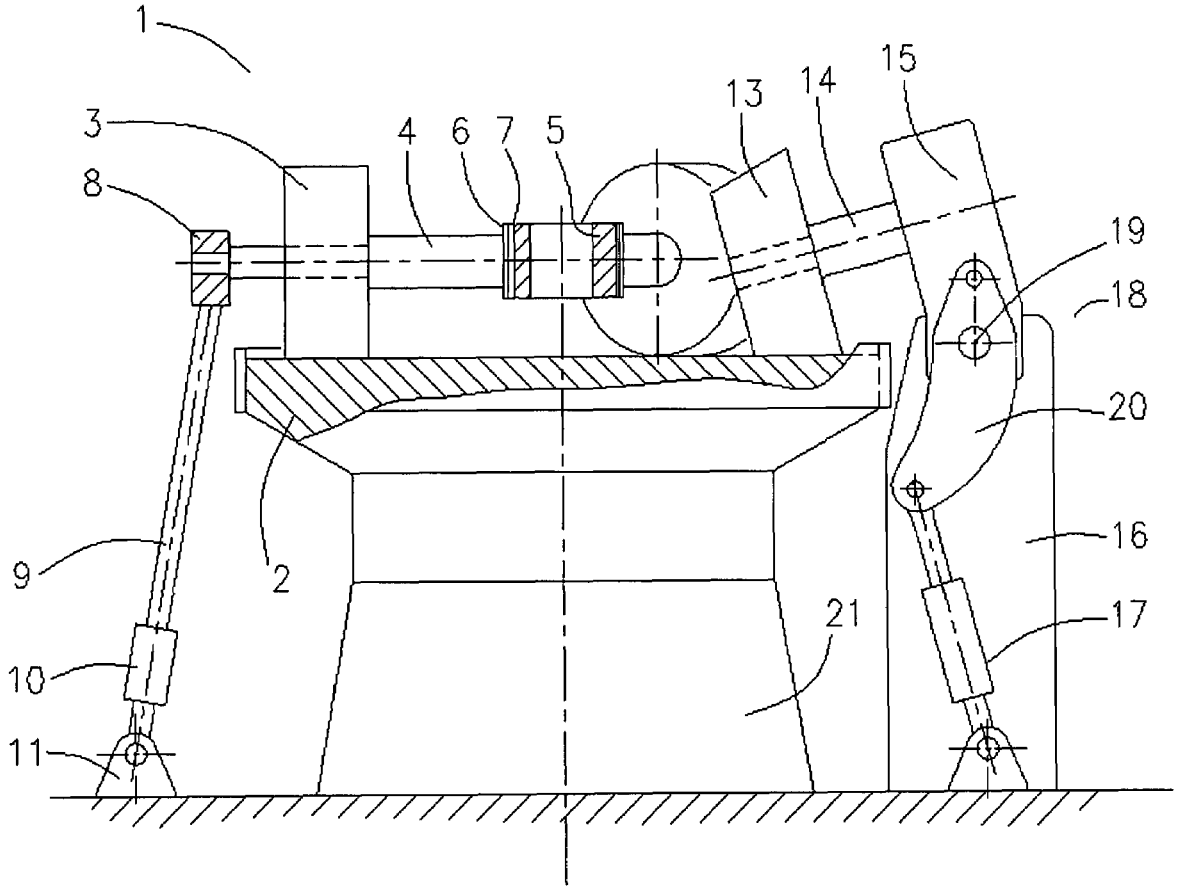
FIG. 1 is a side view of a part of the roller mill present invention.

In FIG. 1 is seen a side view of a roller mill 1, which comprises a horizontal grinding table 2 rotating about a vertical axis and supported by a gear reducer 21. Rollers 3, 13 are configured to operate interactively with the grinding table 2. Roller 3 rotates about a stationary shaft 4 attached to a frame 5. The shafts 4 are attached to the frame 5 by means of flanges 6 on the shafts 4 and corresponding flanges 7 provided on the frame 5 and are located above and over table 2.

On the outer end of each shaft 4 is mounted a bracket 8 to which a draw bar 9 pivotally is attached, whereby the roller 3 can be forced against the grinding table 2 by means of a hydraulic cylinder 10 pivotally retained in a bracket 11, which is anchored in the mill foundation.

With reference to conventionally mounted roller 13, a rocker arm assembly 18 is pivotally mounted to a mill stand 16. Roller 13 is mounted on a shaft 14, which is fixed to an end of a rocker arm 15, for rotation about the axial center line of the shaft 14. The rocker arm 15 is pivotally mounted to the mill stand 16 to turn about a horizontal axis 19. A rocker arm fork 20 is in one end fixed to the rocker arm 15 and in the other end pivotally connected to a hydraulic cylinder 17. The other end of the hydraulic cylinder 17 is pivotally connected to the mill stand 16. Besides this the rocker arm fork 20 is, between the connections to the rocker arm 15 and the hydraulic cylinder 17, pivotally mounted to the mill stand 16 to turn about the horizontal axis 19.

Figure 2:
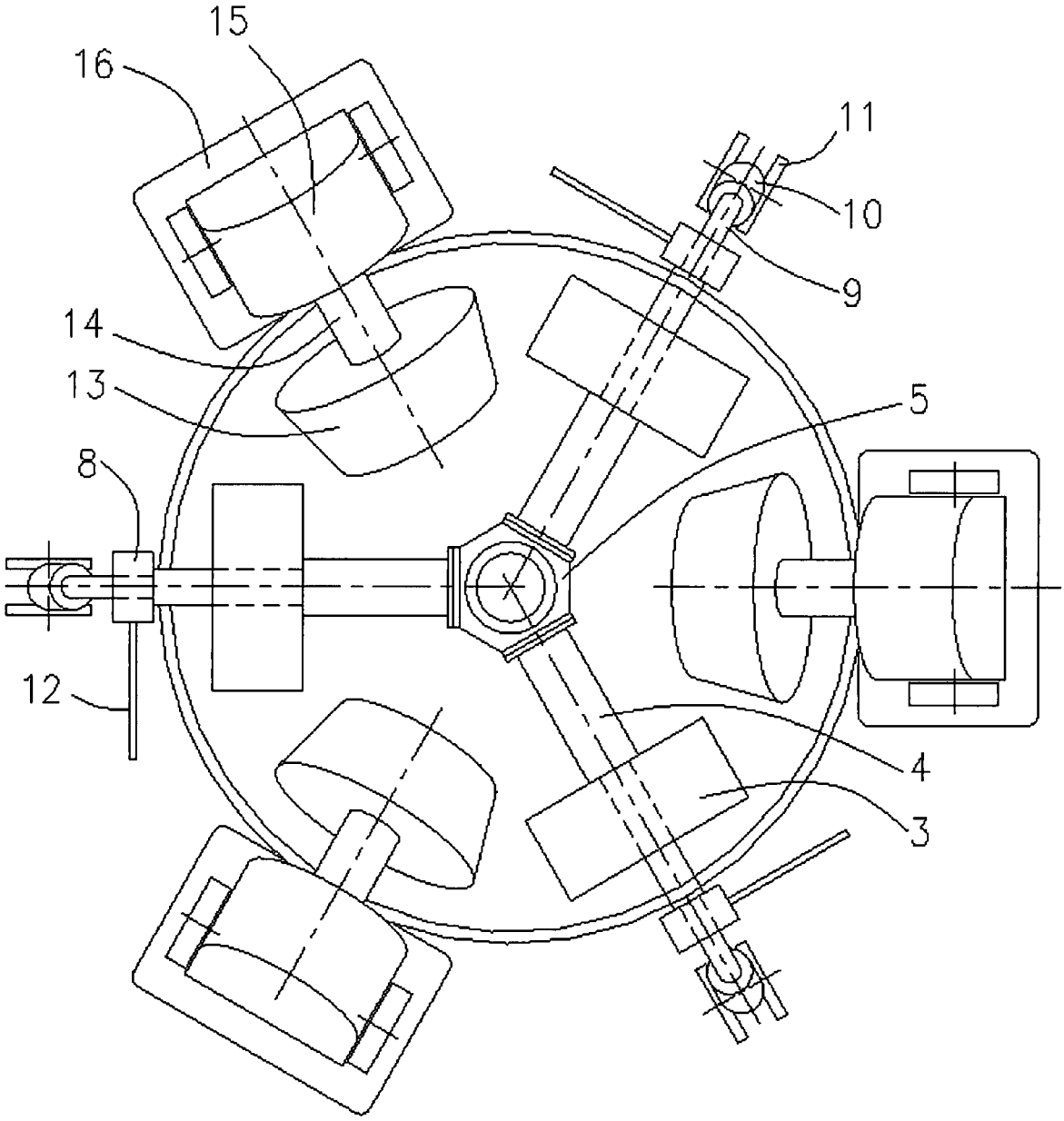
FIG. 2 is a top view of the same part of the roller mill of the present invention.

FIG. 2 shows a top view of the roller mill 1 seen in FIG. 1 having three rollers 13 connected to mill stands 16 and three rollers 3 attached to the frame 5. The roller mill 1 may very well have two rollers 13 connected to mill stands 16 and two rollers 3 attached to the frame 5. Preferably the number of rollers conventionally mounted to mill stands will be equal to the number of rollers mounted to the frame. As a further example, the roller mill may have four rollers 13 connected to mill stands 16 and four rollers 3 attached to the frame 5 or only one roller 13 connected to a mill stand 16 and one roller 3 attached to the frame 5 or any combination of the above-mentioned number of rollers 3, 13 for the mill stands 16 and frame 5, respectively.

The rollers 3 attached to the frame and the rollers 13, which are connected to the mill stands, are situated alternatively and symmetrically around the perimeter of the grinding table 2, and, as a result, the mill stands 16 can be situated symmetrically around the grinding table 2.

The shafts 4 are prevented from moving in the direction of rotation of the grinding table by means of horizontal draw bars or pressure bars 12, which at one end are attached to brackets 8 and at the other end are connected (not shown) to the roller mill structure.

Figure 3:
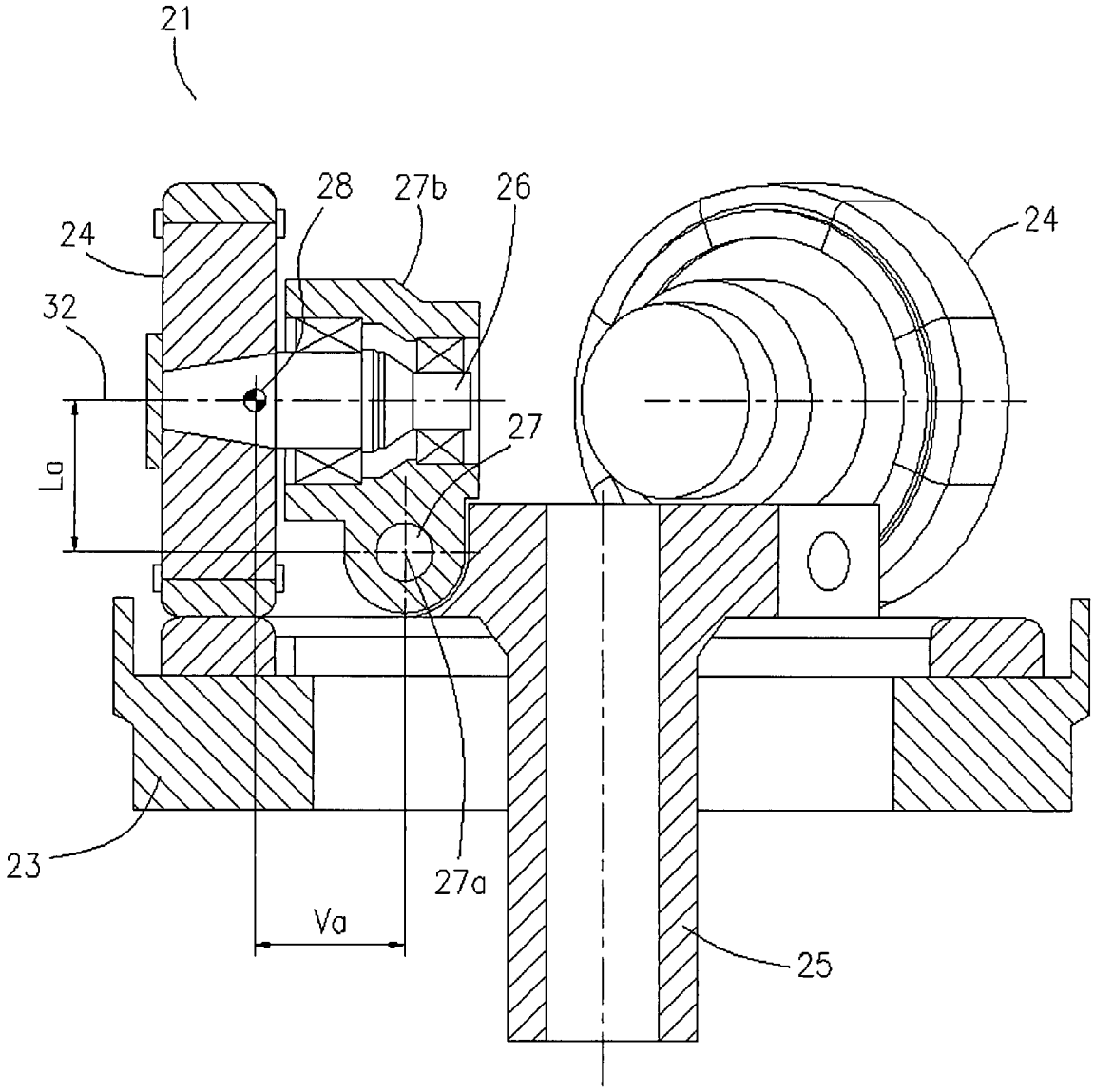
FIG. 3 is a sectional side view of another embodiment of the roller mill of the present invention.

Referring to FIG. 3, there is shown another embodiment of employing rollers that are not connected to mill stands. While in this view, for the purpose of clarity, there is only depicted those rollers not connected to mill stands, the depicted principle is meant to be used in conjunction with rollers connected to mill stands to achieve the full benefit of the invention as the same is more clearly set forth in FIG. 4.

In FIG. 3 there is the figure is seen a sectional view of a roller mill 21 which comprises a horizontal grinding table 23 and a set of rollers 24 operating interactively therewith, with the set of rollers being connected to and turning about a vertical shaft 25. Vertical shaft 25 comes up from beneath and rises through a center portion of table 23. Vertical shaft 25 is connected to a drive motor (not seen) separate from the table drive motor. Vertical shaft 24 can cause the rollers to rotate on the table either in the same direction that the table rotates or in a direction opposite the rotation of the table. In addition, vertical shaft 25 is adopted to move up and down during operation, and resultantly move the rollers up and down, as a means of compensating for roller wear and also to change the camber angle of the roller on the table.

The rollers 24 turn about separate horizontal roller shafts 26 which are connected to the vertical shaft 25 via a hinged connection 27 which allows a roller 24, when turning about this connection, to move freely up and down in a plane which comprises the centerline 32 of the roller shaft.

According to the invention the center 27*a* of rotation of the hinged connection 27, viewed in a vertical plane, is situated under the horizontal plane which comprises the center of mass 28 of the roller 24, the roller shaft 26 and the hinged part 27*b* connected thereto, shown on the drawing by a dot-and-dash line coinciding, for reasons of simplicity, with the centerline 32 of the roller shaft. As a result, the centrifugal force which during the operation of the mill acts upon the roller 24, the roller shaft 26 and the hinge part 27*b* connected thereto, will produce a turning moment about the hinge 27 and hence a downwardly directed force which contributes to the grinding pressure of the roller 24 against the grinding table 23.

The magnitude of the force contributing to the grinding pressure which stems from the centrifugal force will, among other things, depend on the speed of rotation of the set of rollers and on the vertical distance $L_a$ as well as the horizontal distance $V_a$ between the center 27*a* of rotation of the hinged connection and the center of mass 28 for the roller 24, the roller shaft 26 and the hinged part 27*b* connected thereto. In practice it will, therefore, be desirable to maximize the vertical distance $L_a$ to extent possible from a design perspective and to minimize the horizontal distance $V_a$ to extent possible so that the ratio $L_a/V_a$ is as high as possible, preferably higher than about 0.2, most preferably from about 0.2 to about 3, and, if suitable, higher than about 3.

Normally, the grinding table 23 is turned at a certain speed of rotation in order to move the material across the grinding table 23 towards its peripheral edge by means of the centrifugal force. In order to attain a high speed of rolling, defined as the relative speed between the rollers 24 and the grinding table 23, and hence a high capacity of the mill, it is preferred that the set of rollers 24 and the grinding table 23 are turned in opposite directions. For smaller mills the speed of rotation of the roller set 24 must, however, exceed that applied in bigger mills in order to achieve the desired grinding pressure. For avoidance of operational problems in terms of vibrations and similar occurrences in case of excessive speeds of rolling, it is therefore preferred that the set of rollers 24 and the grinding table 23 are turned in the same direction in small mills.

Figure 4:
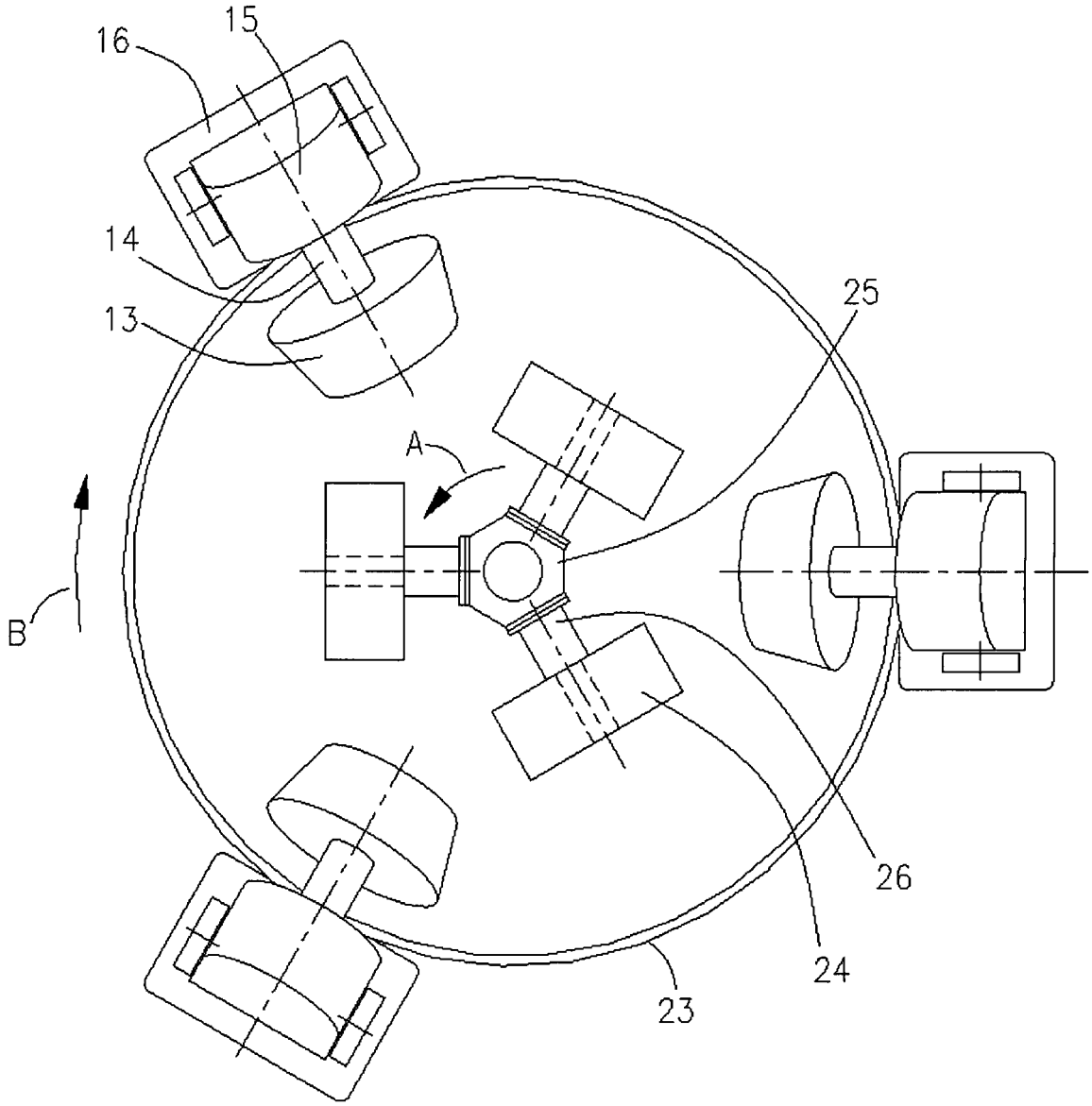
FIG. 4 is a top view of the embodiment of the roller mill depicted in FIG. 3.

Referring to FIG. 4, three rollers 24 rotate in a circular path about a roller shaft 26 which in turn is attached to vertical shaft 25. As depicted, rollers 24 travel around the table 23 in a circular path in the direction of arrow A, which is opposite the direction of rotation, as depicted by arrow B, of table 23, although it is understood that rollers 24 can move in either direction. Also depicted are three conventional rollers 13 which as set forth above are mounted on a shaft 14 fixed to an end of a rocker arm 15, and which in turn is pivotally mounted to mill stand 16. The circular path through which rollers 24 travel keeps rollers 24 sufficiently separated from conventional rollers 13.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

The invention claimed is:

1. A roller mill for grinding solid material, said roller mill comprising a substantially horizontal grinding table and at least two rollers which are configured for interactive operation with said grinding table wherein (i) at least one, but not all, of said at least two rollers each rotates about a stationary shaft connected to a rocker arm pivotally connected to a mill stand which substantially is situated outside said grinding table (ii) the remaining one or more rollers do not utilize a mill stand, and (iii) the rollers that do not that utilize mill stands are essentially indistinguishable in their size and grinding capabilities from the rollers that utilize mill stands.

2. The roller mill of claim 1 wherein the rollers that do not utilize a mill stand each rotates about a stationary shaft attached to a frame situated in the central part of said grinding table.

3. The roller mill of claim 2 wherein the axial center line of the frame coincides with the axial center line of the grinding table.

4. The roller mill of claim 2 wherein the rollers that do not utilize a mill stand each utilize a hydraulic cylinder as a force application device to force said roller against the grinding table.

5. The roller mill of claim 2 wherein the rollers that do not utilize a mill stand each utilizes a system of springs as a force application device to force said roller against the grinding table.

6. The roller mill of claim 2 wherein the stationary shaft is removably attached to the frame.

7. The roller mill of claim 2 wherein the number of rollers that utilize a mill stand ranges from two to four and the number of rollers that do not utilize a mill stand ranges from two to four.

8. The roller mill of claim 7 wherein the number of rollers that utilize a mill stand is equal to the number of rollers that do not utilize a mill stand.

9. The roller mill of claim 2 wherein the rollers that do not that utilize mill stands and the rollers that utilize a mill stand are alternatively and symmetrically arranged around the perimeter of the grinding table.

10. The roller mill of claim 1 wherein the at least one roller that does not utilize a mill stand rotates about a roller shaft which is connected to a vertical shaft via a hinged connection which is connected via a hinged part to the roller shaft, said hinged connection having a center of rotation which allows for a free circular movement of the roller in upward and downward direction in a plane comprising the centerline of the roller shaft, and which roller is configured for interactive operation with the grinding table, wherein further that the center of rotation of the hinged connection in a vertical plane is situated under the horizontal plane which comprises the center of mass of the roller, roller shaft and the hinged part.

11. The roller mill of claim 10 wherein the roller shaft is substantially horizontal.

12. A roller mill of claim 10 wherein the center of rotation of the hinged connection in a vertical plane is situated under the centerline of the roller shaft.

13. The roller mill of claim 10 wherein the ratio of (a) the vertical distance between the center of rotation of the hinged connection and the center of mass for the roller, the roller shaft and the hinged part; to (b) the horizontal distance between the center of rotation of the hinged connection and the center of mass for the roller, the roller shaft and the hinged part connected thereto is higher than about 0.2.

14. The roller mill of claim 13 wherein the ratio of (a) to (b) ranges from about 0.2 to about 3.

15. The roller mill of claim 13 wherein the ratio of (a) to (b) is higher than about 3.

16. The roller mill of claim 10 wherein at least one roller that rotates about a roller shaft which is connected to a vertical shaft and the grinding table turn in opposite directions.

17. The roller mill of claim 10 wherein at least one roller that rotates about a roller shaft which is connected to a vertical shaft and the grinding table turn in the same direction.

18. The roller mill of claim 1 wherein the solid material is cement clinker.

* * * * *

UNITED STATES PATENT AND TRADEMARK OFFICE

CERTIFICATE OF CORRECTION

PATENT NO. : 7,637,446 B2
APPLICATION NO. : 11/897378
DATED : December 29, 2009
INVENTOR(S) : Jason Euculano It is certified that error appears in the above-identified patent and that said Letters Patent is hereby corrected as shown below:

On the Title Page Item (74) Attorney, Agent, or Firm - Daniel DeJoseph Esq.; Aaron Pik Esq., change the name "Pik" to --Pile--.

Signed and Sealed this

Twenty-third Day of March, 2010

David J. Kappos

David J. Kappos
*Director of the United States Patent and Trademark Office*